US007661464B2

(12) United States Patent
Khrustalev et al.

(10) Patent No.: US 7,661,464 B2
(45) Date of Patent: Feb. 16, 2010

(54) EVAPORATOR FOR USE IN A HEAT TRANSFER SYSTEM

(75) Inventors: Dmitry Khrustalev, Woodstock, MD (US); Pete Cologer, York, PA (US); Jessica Maria Garzon, Laurel, MD (US); Charles Stouffer, Kensington, MD (US); Dave Feenan, Ellicott City, MD (US); Jeff Baker, Ellicott City, MD (US); Matthew C. Beres, Cockeysville, MD (US)

(73) Assignee: Alliant Techsystems Inc., Edina, MN (US)

( * ) Notice: Subject to any disclaimer, the term of this patent is extended or adjusted under 35 U.S.C. 154(b) by 266 days.

(21) Appl. No.: 11/275,105

(22) Filed: Dec. 9, 2005

(65) Prior Publication Data

US 2007/0131388 A1 Jun. 14, 2007

(51) Int. Cl.
*F28D 15/00* (2006.01)

(52) U.S. Cl. ..... 165/104.21; 165/104.25

(58) Field of Classification Search ..... 165/104.21, 165/104.25
See application file for complete search history.

(56) References Cited

U.S. PATENT DOCUMENTS

| | | | | |
|---|---|---|---|---|
| 3,490,718 | A | 1/1970 | Vary | |
| 3,613,778 | A | 10/1971 | Feldman, Jr. | |
| 3,677,336 | A * | 7/1972 | Moore, Jr. | 165/104.24 |
| 3,734,173 | A | 5/1973 | Moritz | |
| 3,741,289 | A | 6/1973 | Moore | |
| 3,756,903 | A | 9/1973 | Jones | |
| 3,792,319 | A | 2/1974 | Fries et al. | |
| 3,803,688 | A | 4/1974 | Peck | |
| 3,884,293 | A | 5/1975 | Pessalano et al. | |
| 4,005,297 | A | 1/1977 | Cleaveland | |
| 4,026,348 | A * | 5/1977 | Roberts, Jr. | 165/272 |
| 4,040,478 | A | 8/1977 | Pogson et al. | |
| 4,046,190 | A | 9/1977 | Marcus et al. | |
| 4,087,893 | A | 5/1978 | Sata et al. | |
| 4,116,266 | A | 9/1978 | Sawata et al. | |
| 4,170,262 | A | 10/1979 | Marcus et al. | |
| 4,467,861 | A | 8/1984 | Kiseev et al. | |

(Continued)

FOREIGN PATENT DOCUMENTS

| | | |
|---|---|---|
| DE | 19941398 | 8/2000 |

(Continued)

OTHER PUBLICATIONS

PCT International Search Report (PCT/US2006/045545), mailed Apr. 18, 2007, 6 total pages.

(Continued)

*Primary Examiner*—Cheryl J Tyler
*Assistant Examiner*—Brandon M Rosati
(74) *Attorney, Agent, or Firm*—TraskBritt

(57) ABSTRACT

An evaporator includes a cylindrical barrier wall and a cap that fits at an end of the cylindrical barrier wall. The cylindrical barrier wall defines a central axial opening and an outer cylindrical surface. The cap includes an outer surface that is external to the central axial opening and an inner surface that abuts the central axial opening. A portion of the outer cylindrical surface is configured to define a liquid port extending through the outer cylindrical surface of the cylindrical barrier wall.

11 Claims, 16 Drawing Sheets

U.S. PATENT DOCUMENTS

| | | | | |
|---|---|---|---|---|
| 4,470,450 | A | 9/1984 | Bizzell et al. | |
| 4,503,483 | A | 3/1985 | Basiulis | |
| 4,627,487 | A | 12/1986 | Basiulis | |
| 4,685,512 | A | 8/1987 | Edelstein et al. | |
| 4,770,238 | A | 9/1988 | Owen | |
| 4,819,719 | A | 4/1989 | Grote et al. | |
| 4,830,718 | A | 5/1989 | Stauffer | |
| 4,862,708 | A | 9/1989 | Basiulis | |
| 4,869,313 | A | 9/1989 | Fredley | |
| 4,883,116 | A | 11/1989 | Seidenberg et al. | |
| 4,890,668 | A | 1/1990 | Cima | |
| 4,934,160 | A | 6/1990 | Mueller | |
| 5,002,122 | A | 3/1991 | Sarraf et al. | |
| 5,016,705 | A | 5/1991 | Bahrle | |
| 5,074,957 | A * | 12/1991 | Horiuti et al. | 216/108 |
| 5,103,897 | A | 4/1992 | Cullimore et al. | |
| 5,303,768 | A | 4/1994 | Alario et al. | |
| 5,335,720 | A | 8/1994 | Ogushi et al. | |
| 5,642,776 | A | 7/1997 | Meyer, IV et al. | |
| 5,725,049 | A | 3/1998 | Swanson et al. | |
| 5,761,037 | A | 6/1998 | Anderson et al. | |
| 5,771,967 | A | 6/1998 | Hyman | |
| 5,816,313 | A | 10/1998 | Baker | |
| 5,842,513 | A | 12/1998 | Maciaszek et al. | |
| 5,899,265 | A | 5/1999 | Schneider et al. | |
| 5,944,092 | A | 8/1999 | Van Oost | |
| 5,950,710 | A | 9/1999 | Liu | |
| 5,966,957 | A | 10/1999 | Malhammar et al. | |
| 6,058,711 | A | 5/2000 | Maciaszek et al. | |
| 6,227,288 | B1 | 5/2001 | Gluck et al. | |
| 6,330,907 | B1 | 12/2001 | Ogushi et al. | |
| 6,381,135 | B1 | 4/2002 | Prasher et al. | |
| 6,382,309 | B1 * | 5/2002 | Kroliczek et al. | 165/104.26 |
| 6,415,627 | B1 | 7/2002 | Pfister et al. | |
| 6,450,132 | B1 | 9/2002 | Yao et al. | |
| 6,533,029 | B1 | 3/2003 | Phillips | |
| 6,591,902 | B1 | 7/2003 | Trent | |
| 6,596,035 | B2 | 7/2003 | Gutkowski et al. | |
| 6,615,912 | B2 | 9/2003 | Garner | |
| 6,810,946 | B2 | 11/2004 | Hoang | |
| 6,840,304 | B1 | 1/2005 | Kobayashi et al. | |
| 6,889,754 | B2 | 5/2005 | Kroliczek et al. | |
| 6,907,918 | B2 * | 6/2005 | Connors et al. | 165/104.26 |
| 7,004,240 | B1 | 2/2006 | Kroliczek et al. | |
| 7,143,511 | B2 * | 12/2006 | Connors et al. | 29/890.032 |
| 7,251,889 | B2 | 8/2007 | Kroliczek et al. | |
| 2003/0051857 | A1 | 3/2003 | Cluzet et al. | |
| 2003/0066638 | A1 * | 4/2003 | Qu et al. | 165/186 |
| 2004/0163799 | A1 * | 8/2004 | Connors et al. | 165/104.26 |
| 2004/0182550 | A1 | 9/2004 | Kroliczek et al. | |
| 2004/0206479 | A1 | 10/2004 | Kroliczek et al. | |
| 2005/0061487 | A1 | 3/2005 | Kroliczek et al. | |

FOREIGN PATENT DOCUMENTS

| | | | |
|---|---|---|---|
| EP | 0210337 | | 2/1987 |
| EP | 0 363 721 | | 4/1990 |
| EP | 0987509 | A1 | 3/2000 |
| GB | 2312734 | | 11/1997 |
| JP | 58-88594 | | 5/1983 |
| JP | 2000-055577 | | 2/2000 |
| RU | 2098733 | | 3/1995 |
| SU | 1467354 | | 1/1987 |
| WO | WO 02/02201 | | 1/2002 |
| WO | WO 03/006910 | | 1/2003 |
| WO | 0210661 | A1 | 2/2003 |
| WO | 03054469 | | 7/2003 |
| WO | 2004031675 | | 4/2004 |
| WO | WO 2004/040218 | | 5/2004 |

OTHER PUBLICATIONS

PCT Written Opinion of the International Search Authority (PCT/US2006/045545), mailed Apr. 18, 2007, 8 total pages.

Baumann, Jane, et al., "A methodology for enveloping reliable start-up of LHPs," AIAA Paper 2000-2285 (AIAA Accession No. 33681), AIAA Thermophysics Conference, 34th, Denver, CO, Jun. 19-22, 2000.

Berchowitz, D.M., et al., "Recent Advanced in Stirling Cycle Refrigeration," 1995, 19th International Conference of Refrigeration, The Hague, The Netherlands, 8 apges.

Berchowitz, D.M., Ph. D., "Maximized Performance of Stirling Cycle Refrigeratiors," Natural working fluids '98 IIR—Gustav Lorentzen Conference: Oslo, Norway, Jun. 2-5, 1998, Fluides actifs naturels conference IIF-Gustav Lorentzen Journal: Science et technique du froid, 1998 (4) 422-429.

Berchowitz, David M., "Free-Piston Rankine Compression and Stirling Cycle Machines for Domestic Refrigeration," Presented at the Greenpeace Ozon Safe Conference, Washington, DC, Oct. 18-19, 1993.

Berchowitz, David M., et al., "Design and Testing of a 40 W Free-Piston Stirling Cycle Cooling Unit," 20th International Conference of Refrigeration, IIR/IIF, Sydney, 1999, 7 pages.

Bienert, W.B., et al., "The Proof-of-Feasibility of Multiple Evaporator Loop Heat Pipes," 6th European Symposium on Environmental Systems, May 1997, 6 pages.

Bugby, D., et al., "Across-Gimbal and Miniaturized Cryogenic Loop Heat Pipes," CP654, Space Technology and Applications International Forum-STAIF 2003, edited by M.S. El-Genk, American Institute of Physics, 2003, pp. 218-226.

Bugby, D., et al., "Advanced Components and Techniques for Cryogenic Integration," Environmental systems-International conference; 31st Society of Automotive Engineers New York, 2001-01-2378, Orlando, FL 2001; Jul. (200107), 9 pages.

Bugby, D., et al., "Advanced Components and Techniques for Cryogenic Integration," presented at 2002 Spacecraft Thermal Control Symposium by Swales Aerospace, El Segundo, CA, Mar. 2002, 14 pages.

Bugby, D., et al., "Advanced Components for Cryogenic Integration," Cryocoolers 12, edited by R.G. Ross, Jr., Kluwer Academic/Plenum Publishers, 2003, pp. 693-708.

Bugby, D., et al., "Advanced Components for Cryogenic Integration," Proceedings of the 12th International Cryocooler Conference held Jun. 18-20, 2002, in Cambridge, MA, 15 pages.

Bugby, D., et al., "Development and Testing of a Gimbal Thermal Transport System," Proceedings of the 11th International Cryocooler Conference held Jun. 20-22, 2000, in Keystone, Colorado, 11 pages.

Bugby, D., et al., "Development of Advanced Cryogenic Integration Solutions," presented at the 10th International Cryocoolers Conference on May 26-28, in Monterey, CA, and published in "Cryocoolers 10," by Ron Ross, Jr., Kluwer Academic/Plenum Publishers, NY 1999, 17 pages, Hoang, "Advanced Capillary Pumped Loop (A-CPL) Project Summary," Contract No. NAS5-98103, Mar. 1994, pp. 1-37.

Hoang, Triem T., "Design and Test of a Proof-of-Concept Advanced Capillary Pumped Loop," Society of Automotive Engineers, presented at the 27th Environmental Systems International Conference, New York, 1997, Paper 972326, 6 pages.

Hoang, Trung T., et al., "Development of an Advanced Capillary Pumped Loop," Society of Automotive Engineers, presented at the 27th Environmental Systems International Conference, New York, 1997, Paper 972325, 6 pages.

Janssen, Martien, et al., "Measurement and application of performance characteristics of a Free Piston Stirling Cooler," 9th International Refrigeration and Air Conditioning Conference, Jul. 16-19, 2002, 8 pages.

Kim, Seon-Young, et al., "The Application of Stirling Cooler to Refrigeration," IECEC-97-Intersociety Energy Conversion Engineering Conference, 1997, Conference 32, vol. 2, pp. 1023-1026.

Kotlyarov, E. Yu, et al., "Methods of Increase of the Evaporators Reliability for Loop Heat Pipes and Capillary Pumped Loops," 24th International Conference on Environmental Systems, Jun. 20-23, 1994, 7 pages.

Ku, J., "Recent Advances in Capillary Pumped Loop Technology," 1997 National Heat Transfer Conference, Baltimore, MD, Aug. 10-12, 1997, AIAA 97-3870, 22 pages.

Ku, J., et al., "A high power spacecraft thermal management system," AIAA-1988-2702, Thermophysics, Plasmadynamics and Lasers Conference, San Antonio, TX Jun. 27-29, 1988, 12 pages.

Ku, J., et al., "An Improved High Power Hybrid Capillary Pumped Loop," paper submitted to SAE 19th Intersociety Conference on Environment Systems, SAE 891566, San Diego, CA, Jul. 24-27, 1989, 10 pages.

Ku, J., et al., "Testing of a Capillary Pumped Loop with Multiple Parallel Starter Pumps," SAE Paper No. 972329, 1997.

Ku, J., et al., "The Hybrid Capillary Pumped Loop," paper submitted to SAE 18th Intersociety Conference on Environmental Systems, SAE 881083, San Francisco, CA, Jul. 11-13, 1988, 12 pages.

Ku, Jentung, "Operational Characteristics of Loop Heat Pipes," NASA Goddard Space Flight Center; SAE Paper 99-01-2007, 29th International Conference on Environmental Systems, Denver, Colorado, Jul. 12-15, 1999; Society of Automotive Engineers, Inc.

Kwon, Yong-Rak, et al., "Operational Characteristics of Stirling Machinery," International Congress of Refrigeration, Aug. 17-22, 2003, 8 pages.

McCabe, Michael E., Jr., et al., "Design and Testing of a High Power Spacecraft Thermal Management System," National Aeronautics and Space Administration (NASA), NASA Technical Memorandum 4051, Scientific and Technical Information Division, 1988, 107 pages.

O'Connell, et al., "Hydrogen Loop Pipe Design & Test Results," presented at 2002 Spacecraft Thermal Control Symposium by TTH Research, El Segundo, CA, Mar. 2002, 14 pages.

Oguz, Emre, et al., "Experimental Investigation of a Stirling Cycle Cooled Domestic Refrigerator," 9th Proceedings of the International Refrigeration and Air Conditioning Conference at Purdue, 2002; 9th, vol. 2, pp. 777-784.

Van Oost et al., "Design and Experimental Results of the HPCPL," ESTEC CPL-96 Workshop, Noordwijk, Netherlands, 1996, 19 pages.

Van Oost, Stephane, et al., "Test Results of Reliable and Very High Capillary Multi-Evaporators/Condenser Loop," 25th International Conference on Environmental Systems, Jul. 10-13, 1995, 6 pages.

Welty, Stephen C., et al., "Energy Efficient Freezer Installation Using natural Working Fluids and a Free Piston Stirling Cooler," VI Congreso Iberoamericano De Aire Acondicionado Y Refrigeration, CIAR 2001, Trabajo No. 96, pp. 199-208, Aug. 15-17, 2001.

Yun, James, et al., "Development of a Cryogenic Loop Heat Pipe (CLHP) for Pasive Optical Bench Cooling Applications," 32nd International Conference on Environmental Systems (ICES-2002), Society of Automotive Engineers Paper No. 2002-01-2507, San Antonio, Texas, 2002, 9 pages.

Yun, James, et al., "Multiple Evaporator Loop Heat Pipe," Society of Automotive Engineers, 2001-01-2410, 30th International Conference on Environmental Systems, Jul. 10-13, 2000, 10 pages.

Yun, S., et al., "Design and Test Results of Multi-Evaporator Loop Heat Pipes," SAE Paper No. 1999-01-2051, 29th International Conference on Environmental Systems, Jul. 1999, 8 pages.

European Search Report (Application No. EP 04 01 6584) dated May 15, 2006 (4 total pages).

PCT International Preliminary Examination Report (Application No. PCT/US03/34165) mailed Mar. 8, 2007.

PCT International Search Report issued in International Application No. PCT/USO4/35548.

* cited by examiner

EVAPORATOR FOR USE IN A HEAT TRANSFER SYSTEM

CROSS-REFERENCE TO RELATED APPLICATION

This description is related to U.S. patent application Ser. No. 10/602,022, filed Jun. 24, 2003, now U.S. Pat. No. 7,004,240, issued Feb. 28, 2006, which is a utility conversion of U.S. Provisional Patent Application Ser. No. 60/391,006, filed Jun. 24, 2002, each of which is hereby incorporated herein by reference in its entirety.

TECHNICAL FIELD

This description relates to an evaporator for use in a two-phase loop heat transfer system.

BACKGROUND

Heat transfer systems are used to transport heat from one location (the heat source) to another location (the heat sink). Heat transfer systems can be used in electronic equipment, which often requires cooling during operation.

Loop Heat Pipes (LHPs) and Capillary Pumped Loops (CPLs) are examples of two-phase loop heat transfer systems. Each of these systems includes an evaporator thermally coupled to the heat source, a condenser thermally coupled to the heat sink, fluid that flows between the evaporator and the condenser, and a fluid reservoir for expansion of the fluid. The fluid within the heat transfer system can be referred to as the working fluid. The evaporator includes a wick and a core that includes a fluid flow passage. Heat acquired by the evaporator is transported to and discharged by the condenser.

These systems utilize capillary pressure developed in a fine-pored wick within the evaporator to promote circulation of working fluid from the evaporator to the condenser and back to the evaporator. These systems may further include a mechanical pump that helps recirculate the fluid back to the evaporator from the condenser.

SUMMARY

In one general aspect, an evaporator includes a cylindrical barrier wall and a cap that fits at an end of the cylindrical barrier wall. The cylindrical barrier wall defines a central axial opening and an outer cylindrical surface. The cap includes an outer surface that is external to the central axial opening and an inner surface that abuts the central axial opening. A portion of the outer cylindrical surface is configured to define a liquid port extending through the outer cylindrical surface of the cylindrical barrier wall.

Implementations may include one or more of the following aspects. For example, the evaporator may further include a cylindrical wick that fits within the central axial opening, wherein the liquid port extends into the cylindrical wick. The evaporator may also include a sleeve that is attached to the liquid port of the cylindrical barrier wall. The sleeve may be welded to the cylindrical barrier wall at the outer cylindrical surface.

The evaporator may include a cylindrical wick that fits within the central axial opening, wherein the liquid port extends into the cylindrical wick, an outer sleeve defining a sleeve axis, and a tube within the outer sleeve and extending along the sleeve axis. A first region of the tube may be attached to the outer sleeve and a second region of the tube may be attached to the cylindrical wick. The outer sleeve may be attached to a liquid port of the cylindrical barrier wall. The second region of the tube may be sealed to the cylindrical wick in such manner that a gap between the tube at the second region and the cylindrical wick is smaller than a radius of the pores within the cylindrical wick. The tube may be made of a first metal at the first region and the tube is made of a second metal at the second region; the first region of the tube is welded to the outer sleeve; and the second region of the tube is welded to the cylindrical wick.

The evaporator may include a heat-receiving saddle that covers at least part of the outer cylindrical surface of the cylindrical barrier wall. The heat-receiving saddle may be bonded to the cylindrical barrier wall.

The evaporator may include a cylindrical wick that fits within the central axial opening and that defines a central axial channel, wherein the liquid port extends into the cylindrical wick and into the central axial channel.

The combination of the wick and the cylindrical barrier wall may define circumferential vapor grooves. The vapor port may be in fluid communication with the circumferential vapor grooves. The circumferential vapor grooves may be formed into the wick, the cylindrical barrier wall, or both the wick and the cylindrical barrier wall. The wick and the cylindrical barrier wall may define at least one outer axial vapor channel that intersects and is in fluid communication with the circumferential vapor grooves. The vapor port may be in fluid communication with the at least one outer axial vapor channel. The outer axial vapor channel may be formed into the wick, the cylindrical barrier wall, or both the wick and the cylindrical barrier wall.

The evaporator may include a plug within the central axial channel. The plug may be attached to the cylindrical wick in such a manner that a gap between the plug and the cylindrical wick is smaller than a radius of the pores within the cylindrical wick.

The liquid port may extend into the central axial channel of the wick such that an open end of the liquid port is exposed to the central axial channel of the wick.

The evaporator may include a vapor port extending through the outer cylindrical surface of the cylindrical barrier wall.

The cylindrical barrier wall may be made of nickel; the cap may be made of stainless steel. The heat-receiving saddle may be made of a material having a coefficient of thermal expansion below about 9.0 ppm/K at 20° C. The heat-receiving saddle may be made of a material having a coefficient of thermal expansion of about 6.4 ppm/K at 20° C. The heat-receiving saddle may be made of a material having a coefficient of thermal expansion of about two times the magnitude of the coefficient of thermal expansion of the heat source applied to the evaporator. The heat-receiving saddle may be made of BeO or copper-tungsten.

In another general aspect, an evaporator includes a cylindrical barrier wall defining a central axial opening and an outer cylindrical surface; a cap that fits at an end of the cylindrical barrier wall, the cap including an outer surface that is external to the central axial opening and an inner conical surface that abuts the central axial opening; and a cylindrical wick that is sized to fit within the central axial opening and that includes a portion that extends axially to the end of the cylindrical barrier wall.

Implementations may include one or more of the following aspects. For example, the evaporator may include a heat-receiving saddle that covers at least part of the outer cylindrical surface of the cylindrical barrier wall.

The evaporator may include a liquid port extending through the outer cylindrical surface of the cylindrical barrier wall and into the cylindrical wick.

The cap may include an inner flat surface that contacts the end of the cylindrical barrier wall. The cap may be attached to the end of the cylindrical barrier wall by a weld. The weld may extend from the cylindrical barrier wall to the outer surface of the cap. The cap may be about 0.25 mm wide at the inner flat surface. The cap may be configured to hermetically seal working fluid within the cylindrical barrier wall.

The evaporator may include a plug within the central axial opening and may be attached to the cylindrical wick.

The cap may include a plug protrusion within the central axial opening and may be attached to the cylindrical wick.

In another general aspect, a method of transferring heat includes flowing liquid through a liquid flow channel that is defined within a wick, flowing the liquid from the liquid flow channel through the wick, evaporating at least some of the liquid at a vapor removal channel that is defined at an interface between the wick and a cylindrical barrier wall, and inputting heat energy onto an exterior heat-absorbing surface of a cylindrical barrier wall. The exterior heat-absorbing surface extends the full length of the cylindrical barrier wall.

In another general aspect, an evaporator includes a barrier wall defining a central axial opening and an outer cylindrical surface, wherein the barrier wall is made of nickel; a cylindrical wick that fits within the central axial opening; and a heat-receiving saddle that covers at least part of the outer cylindrical surface of the barrier wall. The cylindrical wick is made of titanium, nickel, stainless steel, porous TEFLON®, or porous polyethylene. The heat-receiving saddle is made of a material having a coefficient of thermal expansion below about 9.0 ppm/K at 20° C.

Implementations may include one or more of the following features. For example, the heat-receiving saddle may extend to the end of the outer cylindrical surface.

The barrier wall may include a cylindrical barrier wall that defines the outer cylindrical surface and caps that fit into the respective ends of the cylindrical barrier wall.

The evaporator may further include a plug within the central axial opening and attached to the wick, wherein the plug is made of titanium or an aluminum alloy.

The heat-receiving saddle may be made of BeO or copper-tungsten.

In another general aspect, a heat transfer system includes a condenser and an evaporator network that includes two or more evaporators fluidly connected to each other and that includes at least one evaporator that is coupled to a liquid line that is coupled to the condenser and at least one evaporator that is coupled to a vapor line that is fluidly coupled to the condenser. Each evaporator in the network includes a cylindrical barrier wall defining a central axial opening and an outer cylindrical surface, a cylindrical wick that fits within the central axial opening, a cap that fits at an end of the cylindrical bather wall, and a liquid port extending through the outer cylindrical surface of the cylindrical barrier wall and into the cylindrical wick. The cap includes an outer surface that is external to the central axial opening and an inner surface that abuts the central axial opening.

Implementations may include one or more of the following features. For example, the heat transfer system may include a pumping system coupled to the condenser and the evaporator. The pumping system may include a mechanical pump within the liquid line or a passive secondary heat transfer loop including a secondary evaporator.

The two or more evaporators may be connected in series such that the working fluid is able to flow into and out of each evaporator through its liquid port.

The evaporator's liquid may flow from one evaporator to the next evaporator.

The heat transfer system may include a reservoir. The liquid coming out of the last evaporator in the series flows through a separate line into either the condenser or the fluid reservoir.

Each evaporator in the network may include a vapor port, with each vapor port being joined together to form a single vapor line that couples to the condenser.

The liquid mass flow rate into each evaporator exceeds the vapor mass flow rate coming off each evaporator such that the liquid mass flow rate coming off each evaporator is greater than zero.

The heat transfer system may include a fluid reservoir that is hydraulically linked to the condenser.

In another general aspect, a heat transfer system includes a condenser and an evaporator network. The evaporator network includes two or more evaporators fluidly connected to each other and including at least one evaporator that is coupled to a liquid line that is coupled to the condenser and at least one evaporator that is coupled to a vapor line that is fluidly coupled to the condenser. Each evaporator in the network includes a cylindrical barrier wall defining a central axial opening and an outer cylindrical surface, a cap that fits at an end of the cylindrical barrier wall, the cap including an outer surface that is external to the central opening and an inner conical surface that abuts the central opening, and a cylindrical wick that is sized to fit within the central axial opening and that includes a portion that extends axially to the end of the cylindrical barrier wall.

In another general aspect, a heat transfer system includes a condenser and an evaporator network. The evaporator network includes two or more evaporators fluidly connected to each other and includes at least one evaporator that is coupled to a liquid line that is coupled to the condenser and at least one evaporator that is coupled to a vapor line that is fluidly coupled to the condenser. Each evaporator in the network includes a barrier wall defining a central axial opening and an outer cylindrical surface, a cylindrical wick that fits within the central axial opening, and a heat-receiving saddle that covers at least part of the outer cylindrical surface of the barrier wall. The barrier wall is made of nickel. The cylindrical wick is made of titanium, nickel, stainless steel, porous TEFLON®, or porous polyethylene. The heat-receiving saddle is made of a material having a coefficient of thermal expansion below about 9.0 ppm/K at 20° C.

In another general aspect, a method of making an evaporator includes inserting a cylindrical wick into a central axial opening of a cylindrical barrier wall such that an interference fit forms between the cylindrical wick and the cylindrical barrier wall, and metallurgically bonding the cylindrical barrier wall to a heat-receiving saddle that is made of a material having a coefficient of thermal expansion of about two times the magnitude of the coefficient of thermal expansion of the heat source to be applied to the evaporator.

A low-coefficient of thermal expansion (CTE) material such as BeO can be used for the heat-receiving saddle, at least in part because the heat-receiving saddle does not have to be compatible with ammonia (ammonia would be contained within the barrier wall) or weldable (since it can be soldered). Among other things, the selection of BeO as the material for use in the heat-receiving saddle may be useful in promoting uniformity for the surface temperature of the heat source to be cooled and the evaporator.

Using low-CTE materials for the evaporator has been challenging in the past, partly because most low-CTE materials have a low thermal conductivity. Traditional evaporator fabrication techniques, such as swaging of the evaporator heat-receiving casing onto the cylindrical wick or hot insertion of the cylindrical wick into the heat-receiving casing with an interference fit, are not as feasible if the evaporator casing is to be made with a relatively low-CTE material. With a relatively low-CTE material, the temperature for the hot insertion could be too high to provide suitable mechanical and thermal contact under the high internal pressure of ammonia. Compatibility between the material and ammonia is also a factor that can prevent some low-CTE materials from being used for the evaporator casing.

In one implementation of the evaporator described herein, the wick is hot inserted with an interference fit into a thin-walled cylindrical barrier wall, which is then soldered to a low-CTE saddle, thus facilitating fabrication.

The evaporator and the heat transfer system described herein can be used in high-energy laser systems with multiple laser diodes, where space for cooling is limited. The evaporator can fit between diode towers in the laser system, such that the heat transfer system can be designed to fit within a relatively small footprint, for example, 1 cm×1 cm×8 cm volume. Moreover, the evaporators can receive heat from at least two sides of the heat-receiving saddle to accommodate space requirements.

The entire length of the cylindrical barrier wall can be configured to receive heat, at least in part because the liquid ports of the evaporator are formed along the cylindrical barrier wall, and because the wick can be extended to substantially the edge of the cylindrical barrier wall.

Other features and advantages will be apparent from the description, the drawings, and the claims.

DESCRIPTION OF DRAWINGS

Like reference symbols in the various drawings indicate like elements.

DETAILED DESCRIPTION

Figure 1:
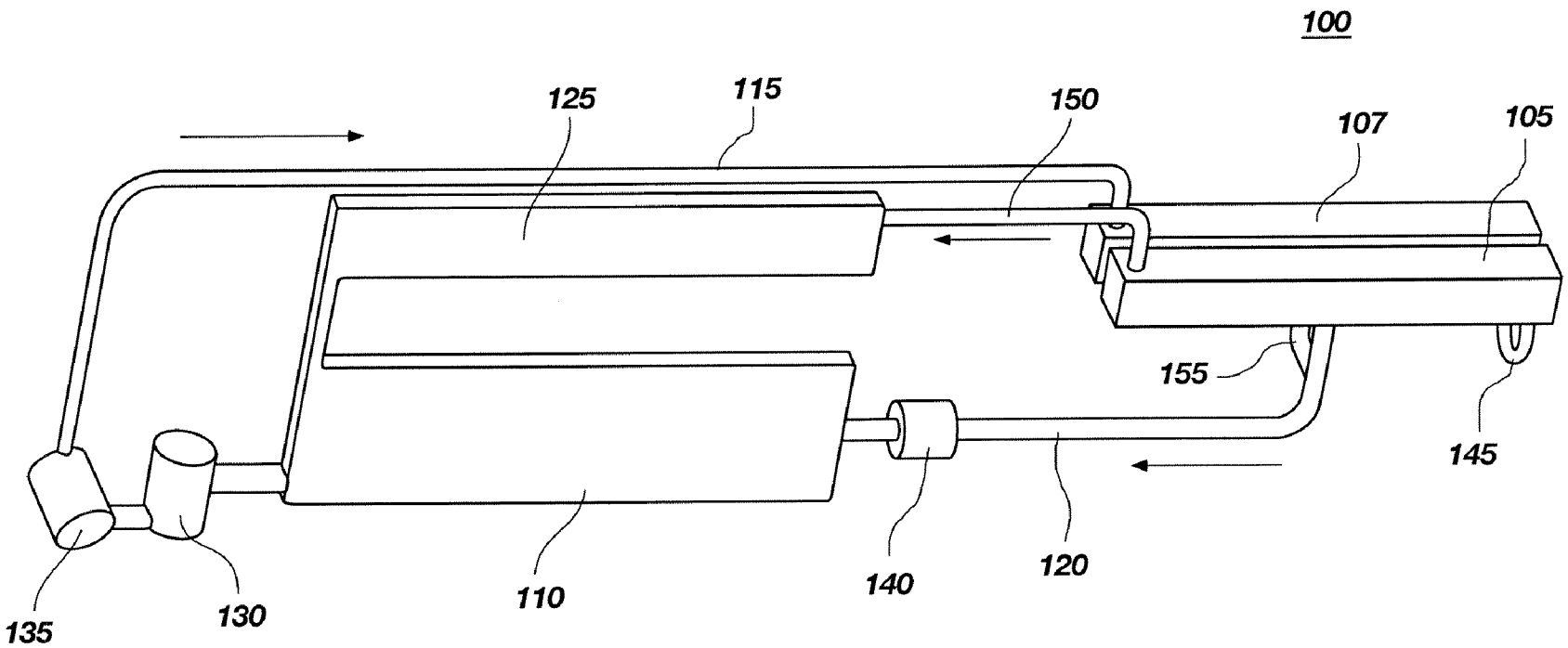
FIG. 1 is a schematic of a heat transfer system.

Referring to FIG. 1, a heat transfer system 100 includes an evaporator 105 and a condenser 110 coupled to the evaporator 105 by a liquid line 115 and a vapor line 120. The condenser 110 is in thermal communication with a heat sink or a radiator and is hydraulically linked to the subcooler 125, and the evaporator 105 is in thermal communication with a heat source (not shown). The heat transfer system 100 includes a reservoir 130 coupled to the liquid line 115 for additional pressure containment, as needed. The reservoir 130 is hydraulically linked to the condenser 110. The heat transfer system 100 also includes some sort of pumping system such as, for example, a mechanical pump 135. While the system 100 is shown as having a second evaporator 107, the system 100 can be designed with a single evaporator 105 or a plurality of evaporators in a fluid network, as discussed below. In the design of FIG. 1, the evaporators 105, 107 are connected in series such that liquid flows into the second evaporator 107 from the condenser 110, then out of the second evaporator 107, and into the evaporator 105.

The liquid supplied to each evaporator (either from the condenser or from the previous evaporator in the network) can be assisted with a mechanical pump 135 to push liquid towards the evaporators 105, 107. The evaporators in the network can be connected in series with a tubing 145 that allows liquid from the second evaporator 107 to flow to the next evaporator 105 in the series. The liquid coming out of the last evaporator 105 in the series flows through a separate line 150 into either the condenser 110, the reservoir 130, or the subcooler 125. The vapor ports 220 of the evaporators 105, 107 can be joined together with a vapor line 155 to effectively form a single vapor line leading the vapor generated by both evaporators 105, 107 to the condenser 110.

In general, vapor flow is driven by capillary pressure developed within the evaporator 105, and heat from the heat source is rejected by vapor condensation in tubing distributed across the condenser 110 and the subcooler 125. Additionally, the mechanical pump 135 helps pump liquid back into the evaporator 105.

If two or more evaporators 105, 107 are used in the system 100, then a back pressure regulator 140 or a flow regulator (not shown) can be used in the system 100 to achieve uniform fluid flow to sustain more stable operation. As shown in FIG. 1, the back pressure regulator 140 is positioned in the vapor line 120 before the condenser 110. The flow regulator is positioned in the liquid line 115 between the condenser 110 and the first evaporator in the series of evaporators.

Figure 2:
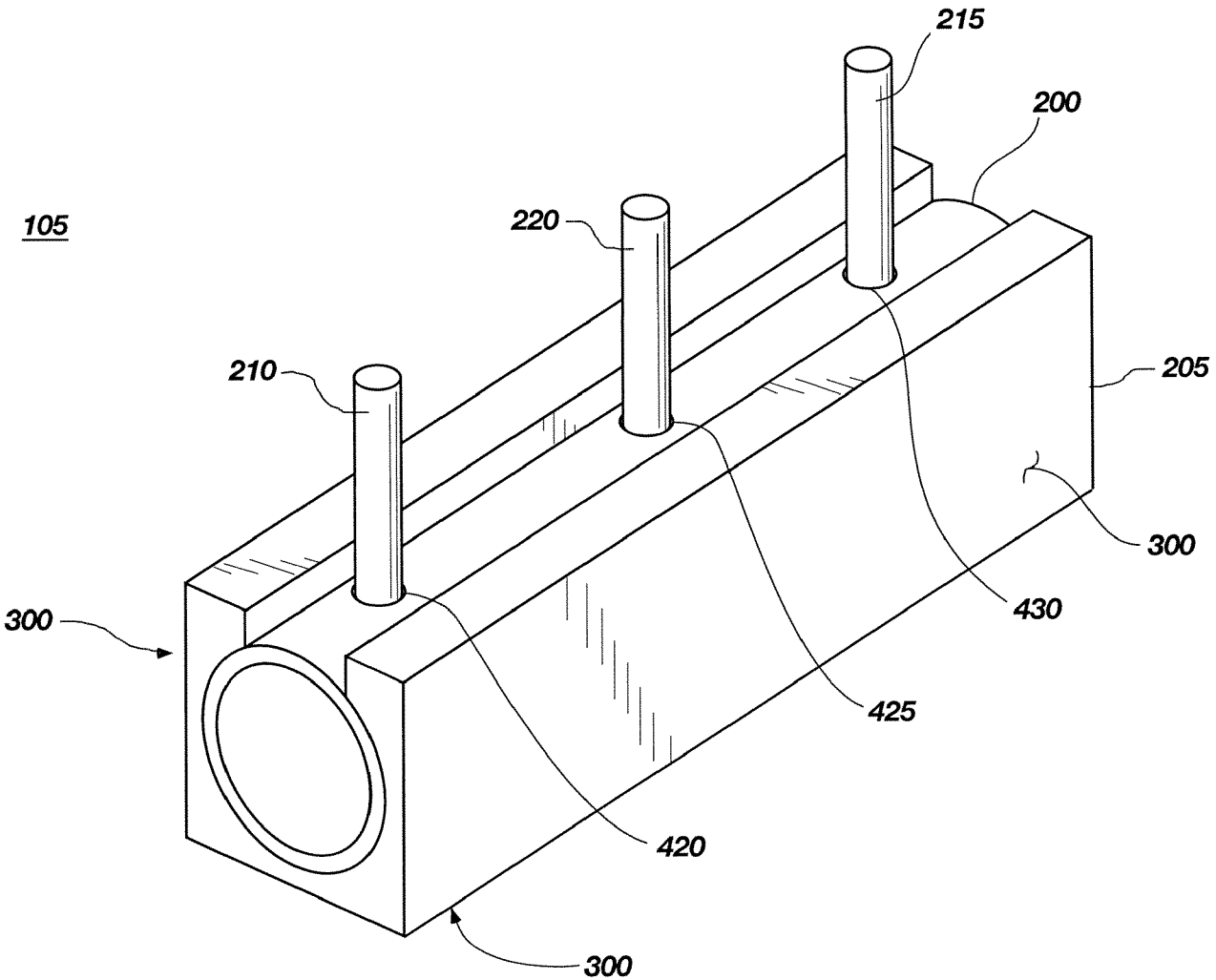
FIG. 2 is a perspective view of an evaporator used in the heat transfer system of FIG. 1.

Referring to FIG. 2, the evaporator 105 includes a barrier wall 200 for enclosing working fluid within the evaporator 105, a heat-receiving saddle 205 that covers at least part of an outer surface of the barrier wall 200, a cylindrical wick (not shown in FIG. 2, but shown in FIGS. 7-10C) within the barrier wall 200, a liquid inlet port 210 that extends through the barrier wall 200 and through a cylindrical wick, a liquid outlet port 215 that extends through the barrier wall 200 and into the cylindrical wick, and a vapor port 220 that extends through the barrier wall 200. The evaporator 105 may be made to withstand a heat load of 800 W (that may be distributed as 400 W on one surface of the evaporator 105 and as 400 W on another surface of the evaporator 105), and have a heat conductance about 30 W/K or more. Moreover, ammonia is particularly useful as a working fluid when the evaporator 105 operates in the −40° C. to +100° C. temperature range, at least in part because ammonia performs well in this temperature range.

Figure 3:
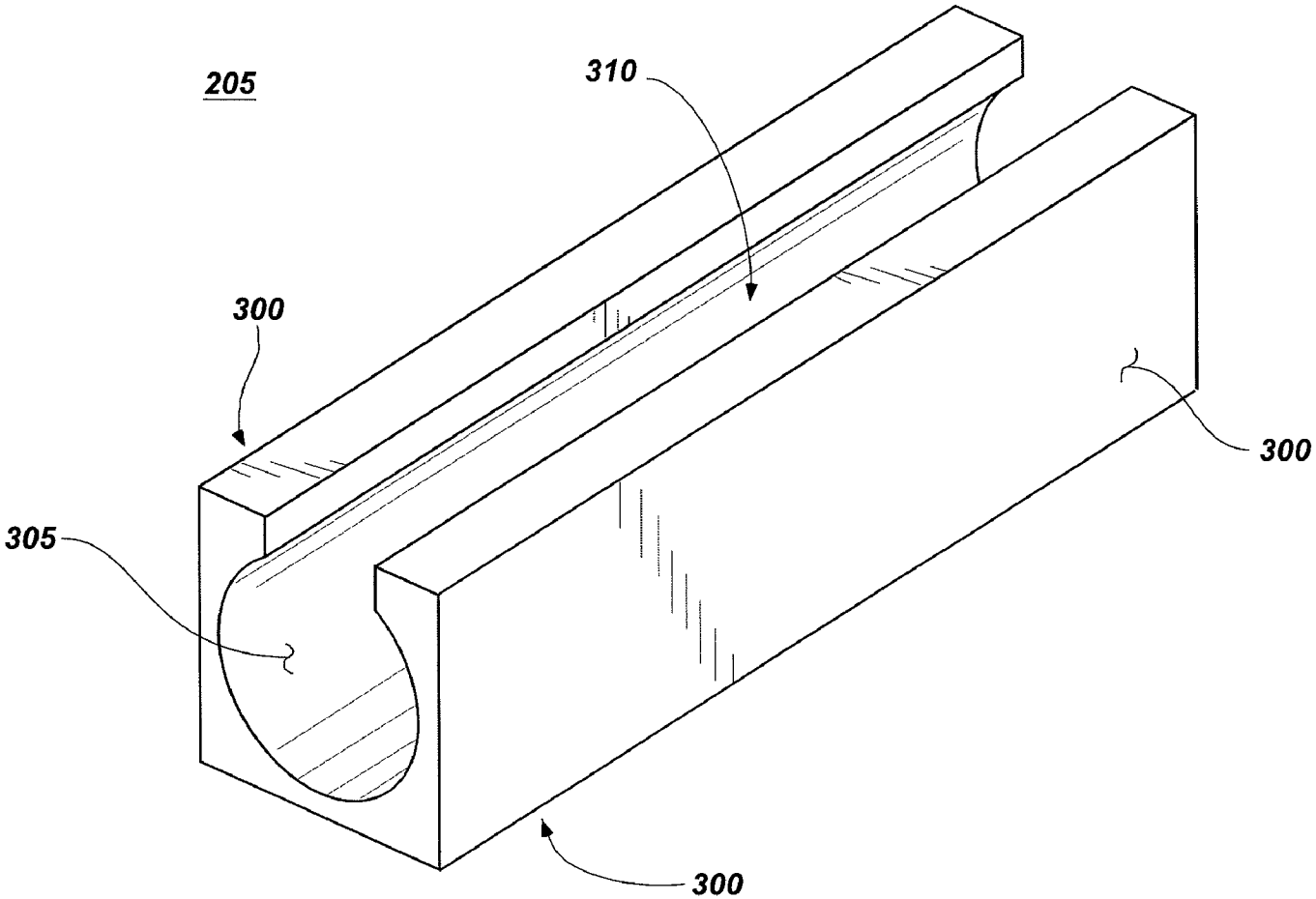
FIG. 3 is a perspective view of a heat-receiving saddle of the evaporator of FIG. 2.

Referring also to FIG. 3, the heat-receiving saddle 205 has at least one outer surface 300 that is configured to receive heat from a heat source in an efficient manner. For example, if the heat source is a flat heat source, then the heat-receiving outer surface 300 can be configured as a flat surface that enables good thermal conductance between the outer surface 300 and the heat source. The heat-receiving saddle 205 may have two outer surfaces 300 for receiving heat from a heat source with several surfaces or for receiving heat from two or three different heat sources. The heat-receiving saddle 205 has an inner surface 305 that has a shape that is complementary to the shape of the barrier wall 200. As shown, the inner surface 305 is cylindrical. Moreover, the heat-receiving saddle 205 defines an axial opening 310 along one side of the saddle 205. The axial opening 310 permits an easier or more convenient assembly of the saddle with the evaporator with the ports 210, 215, 220 welded to the barrier wall 200. In one implementation, the heat-receiving saddle 205 is made of a material having a coefficient of thermal expansion below about 9.0 ppm/K at 20° C. and is made of a material that is within about two times the magnitude of the coefficient of thermal expansion of the heat source applied to the heat-receiving saddle 205. For example, if the heat source has a CTE of about 3 ppm/K at 20° C., then the heat-receiving saddle can be made of about 99.5% Beryllium Oxide (BeO), which has a coefficient of thermal expansion of about 6.4 ppm/K at 20° C. Moreover, BeO has a thermal conductivity of almost about 250 W/(m-K). The heat-receiving saddle 205 may also be plated with nickel (Ni) or any other suitable conductive material. The heat-receiving saddle 205 may be fabricated by molding or machining.

Figure 4:
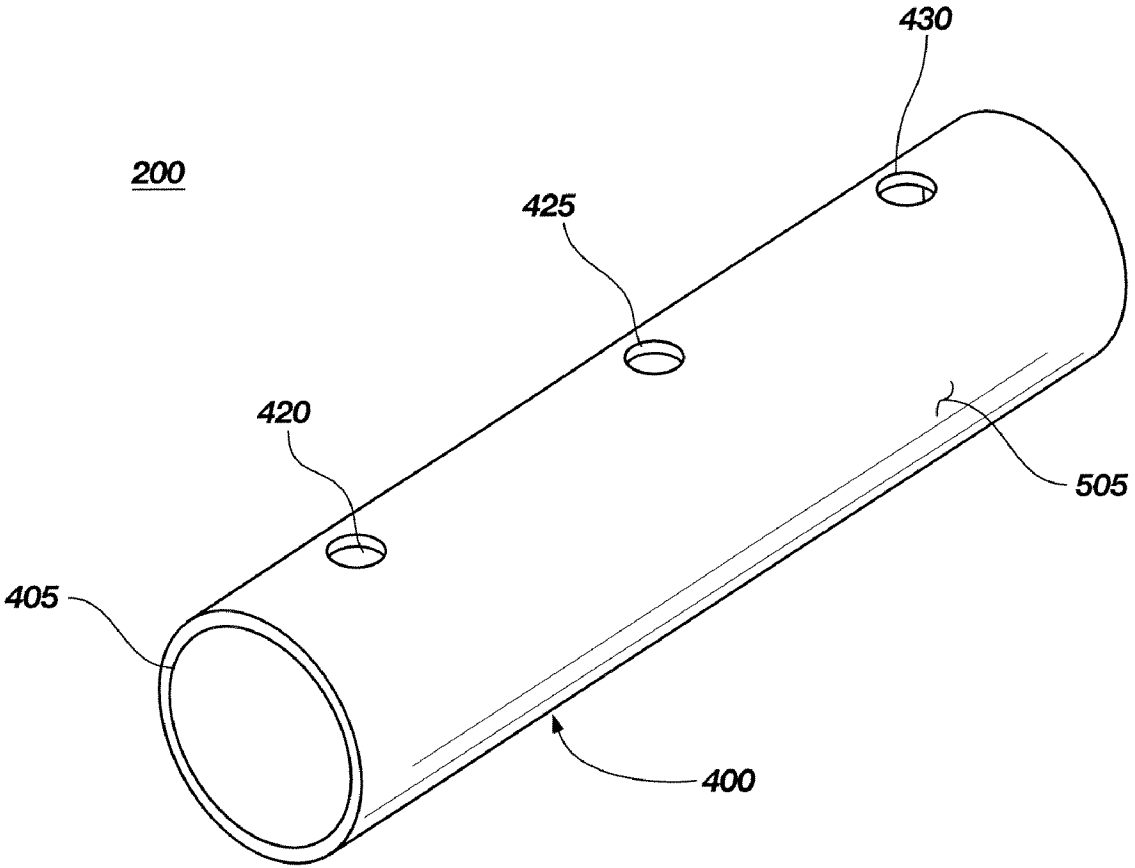
FIG. 4 is a perspective view of a barrier wall of the evaporator of FIG. 2.
Figure 5:
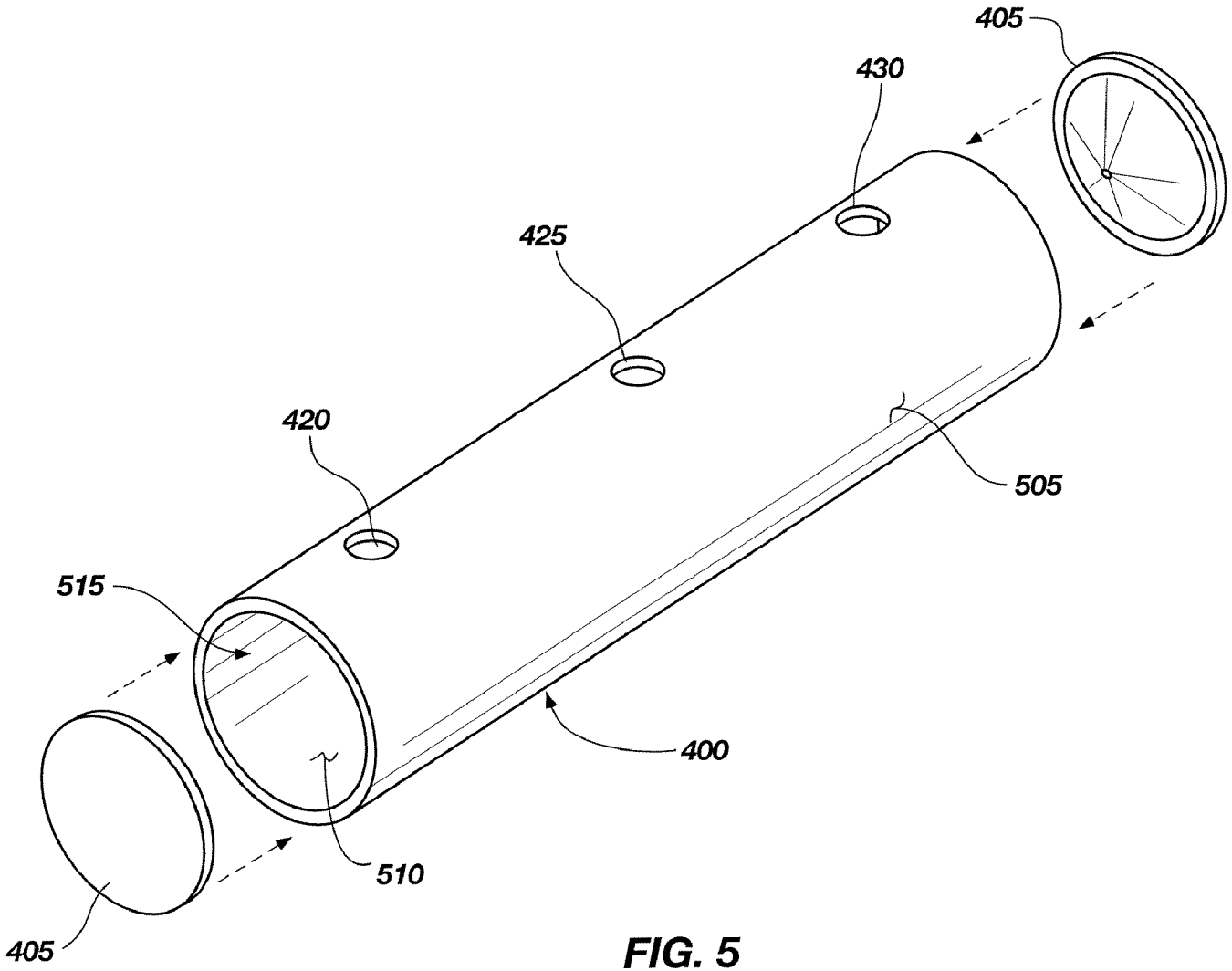
FIG. 5 is an exploded perspective view of the barrier wall of FIG. 4.

Referring also to FIGS. 4 and 5, the barrier wall 200 can be configured as a vacuum-tight casing that contains the working fluid and that is in intimate thermal contact with the heat-receiving saddle 205. The barrier wall 200 includes a cylindrical barrier wall 400 and a set of end caps 405 that fit at an end of the cylindrical barrier wall 400. The cylindrical barrier wall 400 includes an inner surface 510 that defines a central axial opening 515 for receiving a cylindrical wick 800 (as shown in FIGS. 7-10C), and an outer cylindrical surface 505 that is sized to fit within the heat-receiving saddle 205 and contact the inner surface 305. The cylindrical barrier wall 400 is metallurgically bonded, for example, by soldering, to the heat-receiving saddle 205 along its entire length. The thermal resistance at the solder interface is less than about 0.1 K-cm$^2$/W, which results in a corresponding temperature difference of less than about 5 K for a heat flux of about 50 W/cm2. The cylindrical barrier wall 400 is also configured to define holes 420, 425, 430 through which the respective ports 210, 220, 215 pass. The holes 420, 425, 430 are sized to accommodate the outer diameter of the respective ports 210, 220, 215. The cylindrical barrier wall 400 is made of any suitable fluid-containment material, such as, for example, nickel.

Figure 6B:
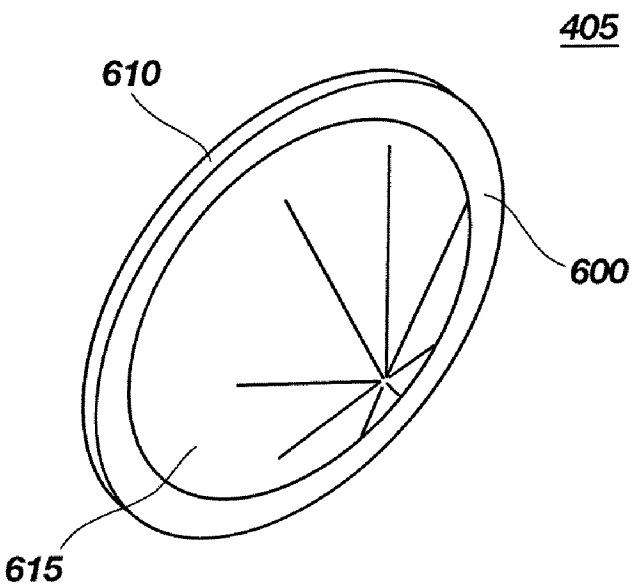
FIG. 6B is a perspective view of the end cap of FIG. 6A.
Figure 6A:
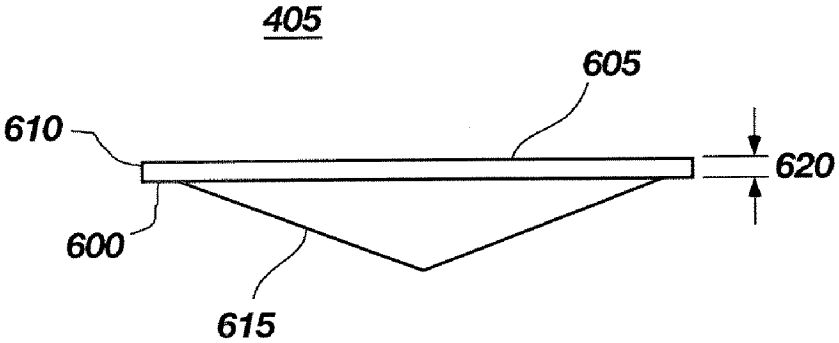
FIG. 6A is a side cross-sectional view of an end cap of the barrier wall of FIG. 4.
Figure 7:
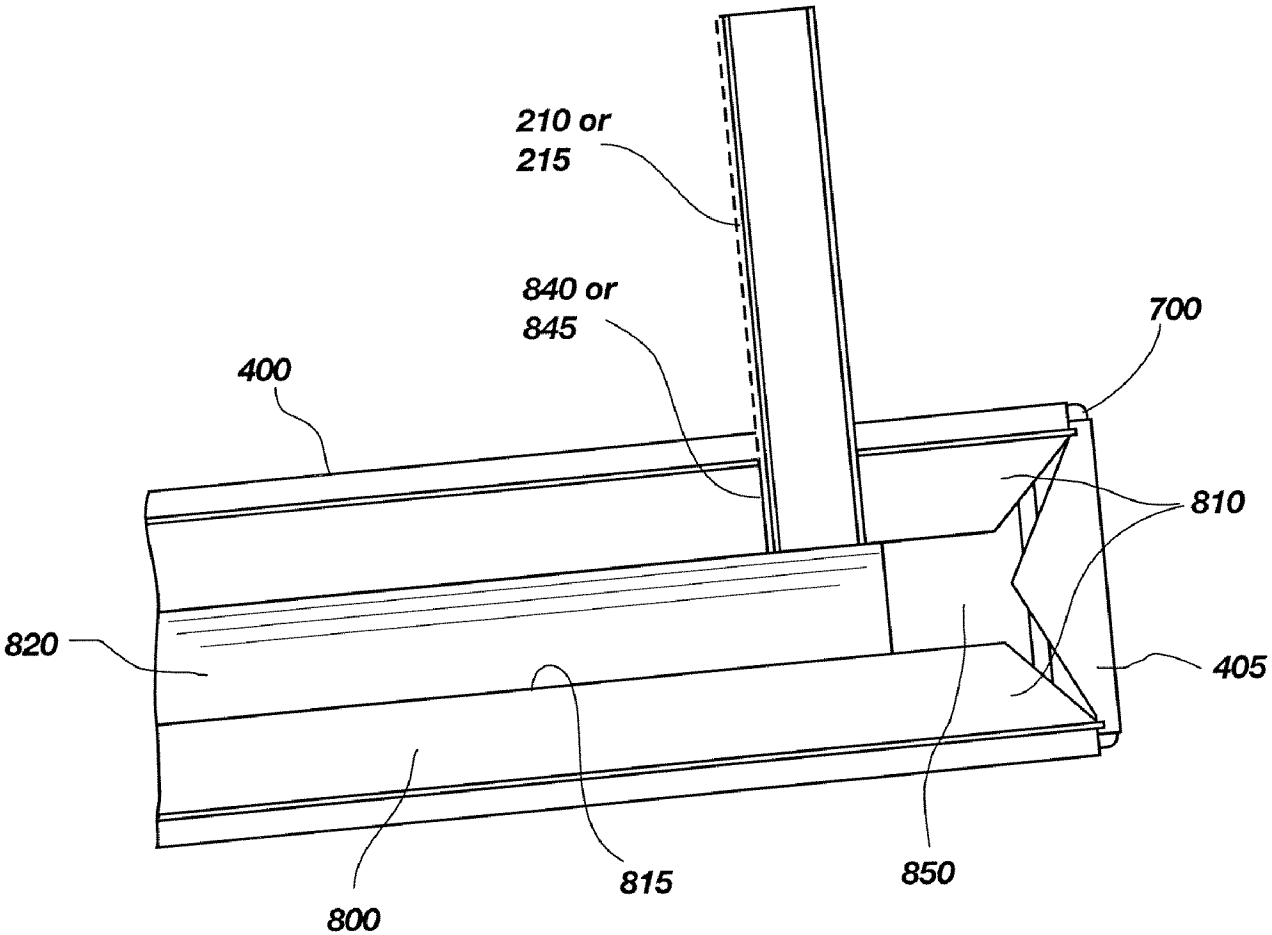
FIG. 7 is an axial cross-sectional view of a portion of the evaporator of FIG. 2.
Figure 8:
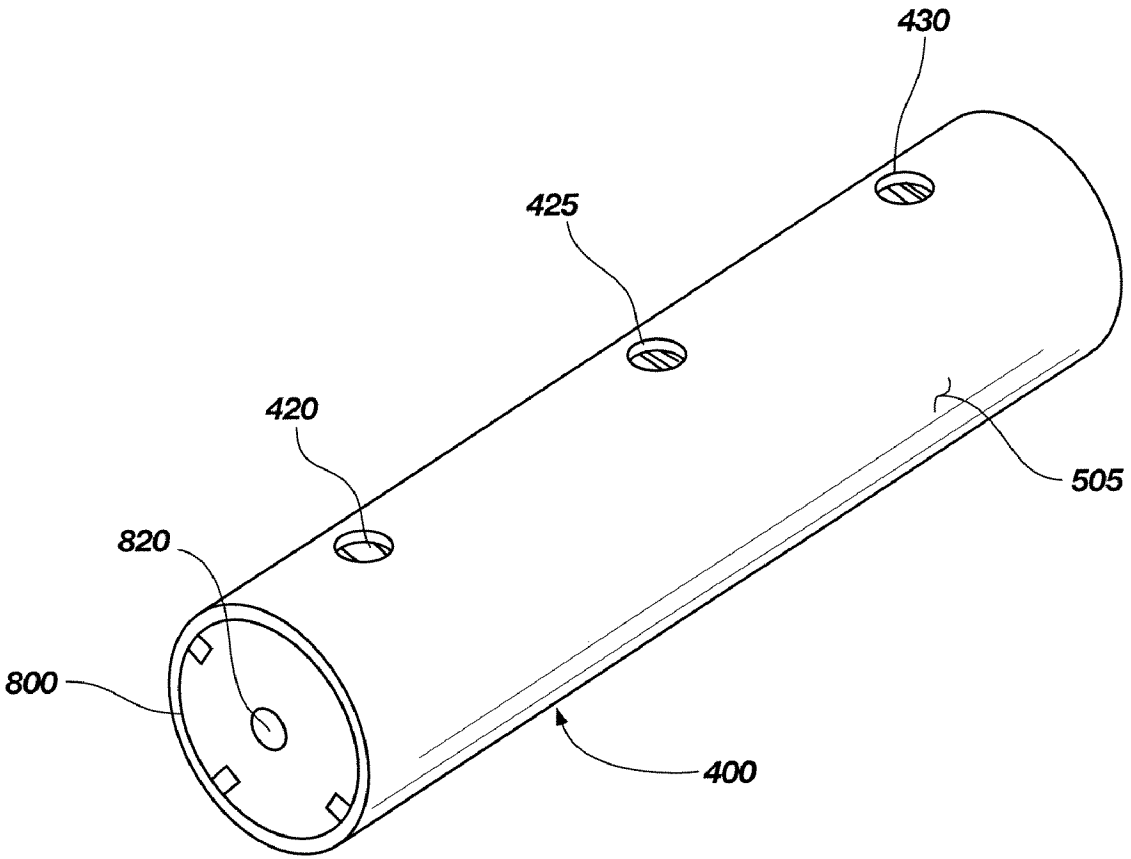
FIG. 8 is a perspective view of a cylindrical wick and a cylindrical barrier wall of the evaporator of FIG. 2.
Figure 9:
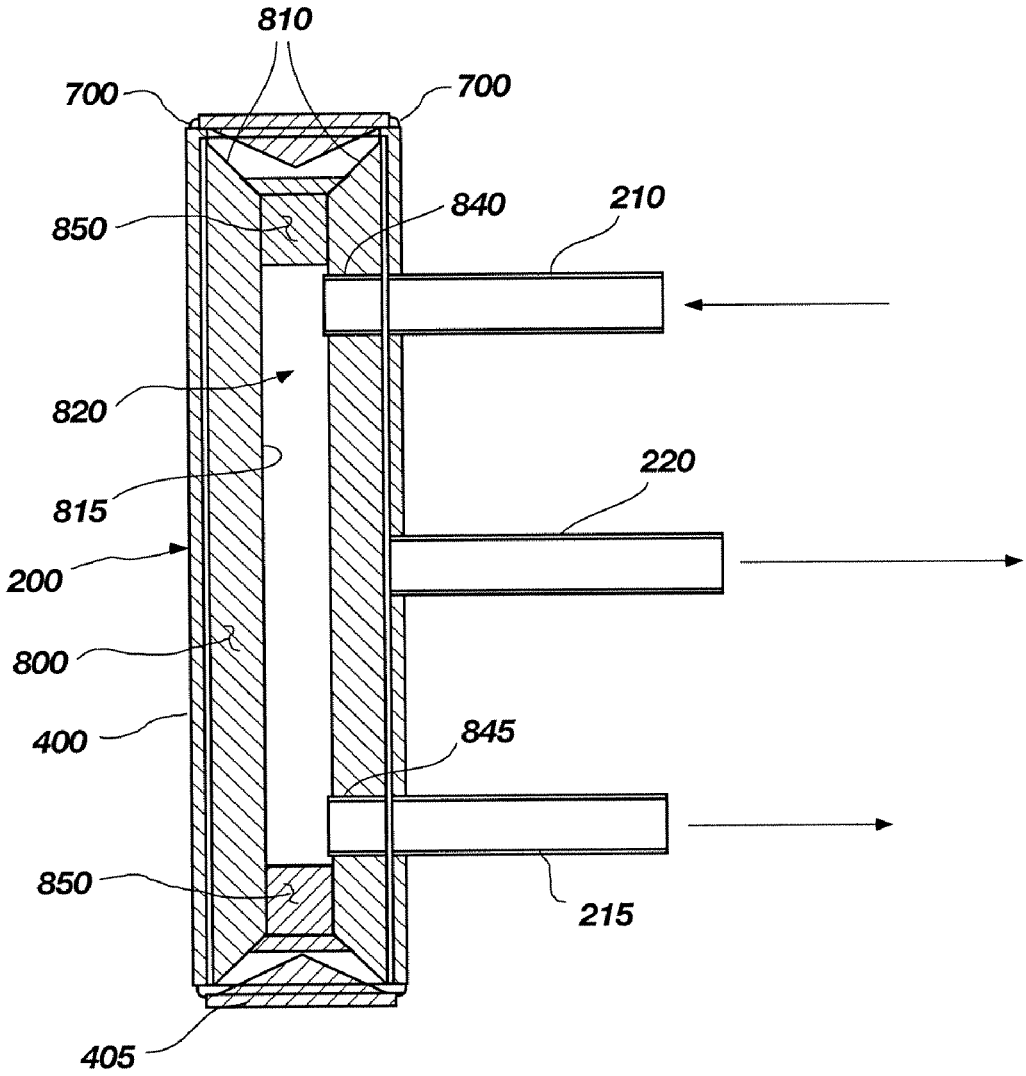
FIG. 9 is an axial cross-sectional view of a portion of the evaporator of FIG. 2.
Figure 10A:
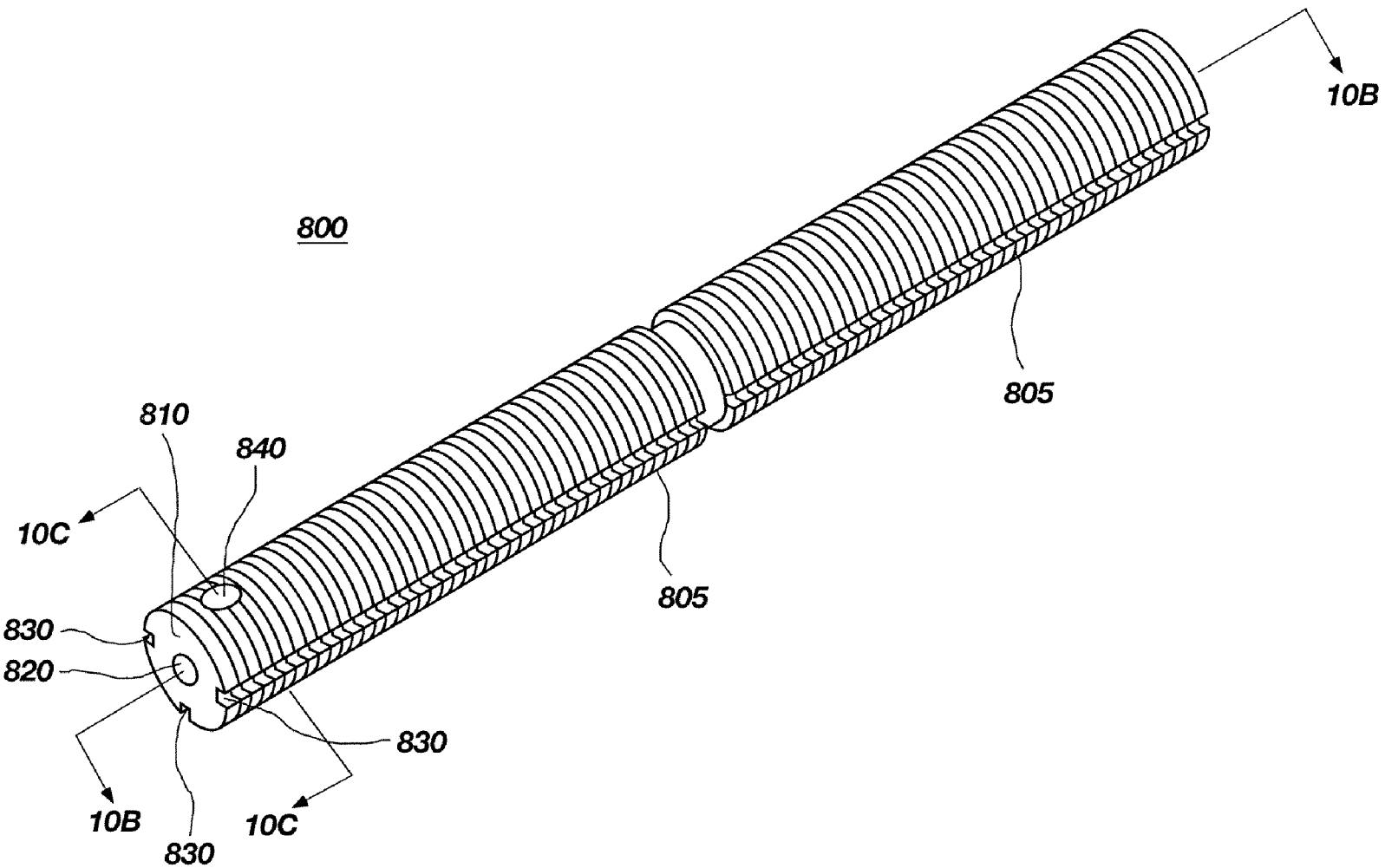
FIG. 10A is a perspective view of the cylindrical wick of FIG. 8.
Figure 10B:
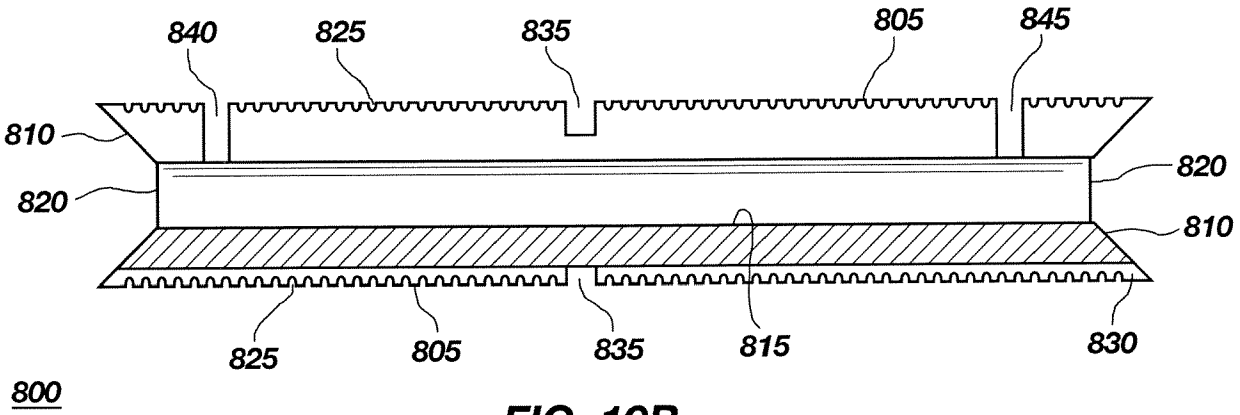
FIG. 10B is an axial cross-sectional view of the cylindrical wick of FIG. 10A.
Figure 10C:
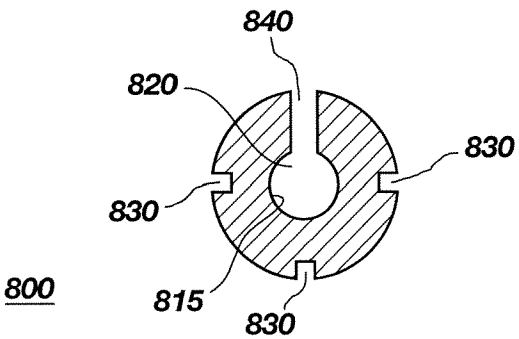
FIG. 10C is a transverse cross-sectional view of the cylindrical wick of FIG. 10A.
Figure 11:
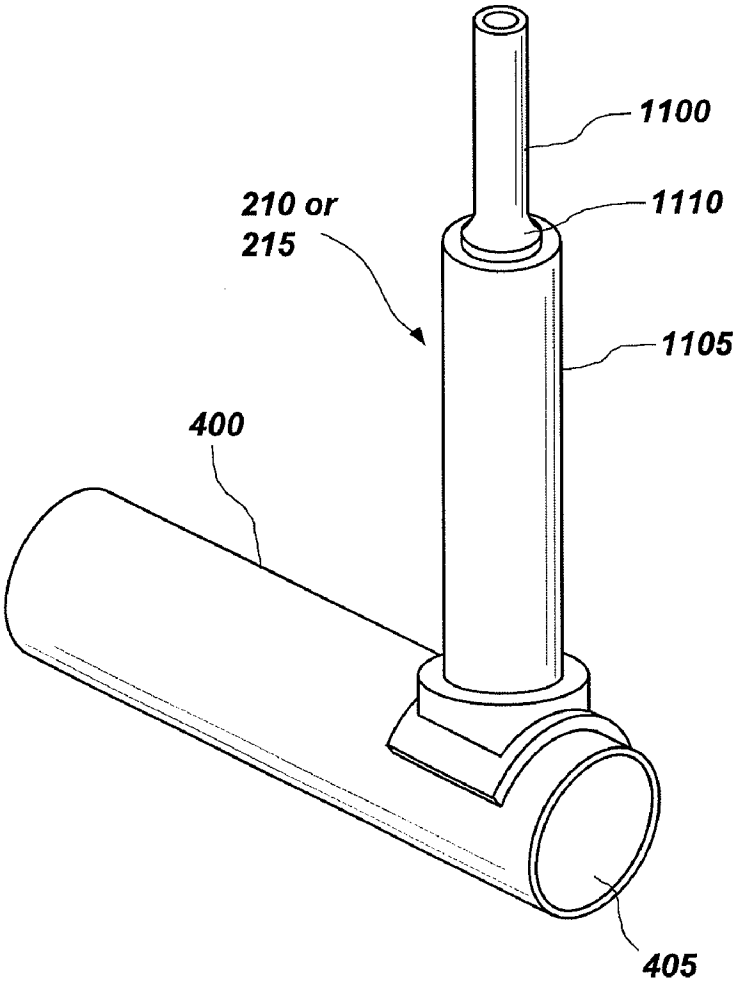
FIG. 11 is a perspective view of a portion of the evaporator of FIG. 2.
Figure 12:
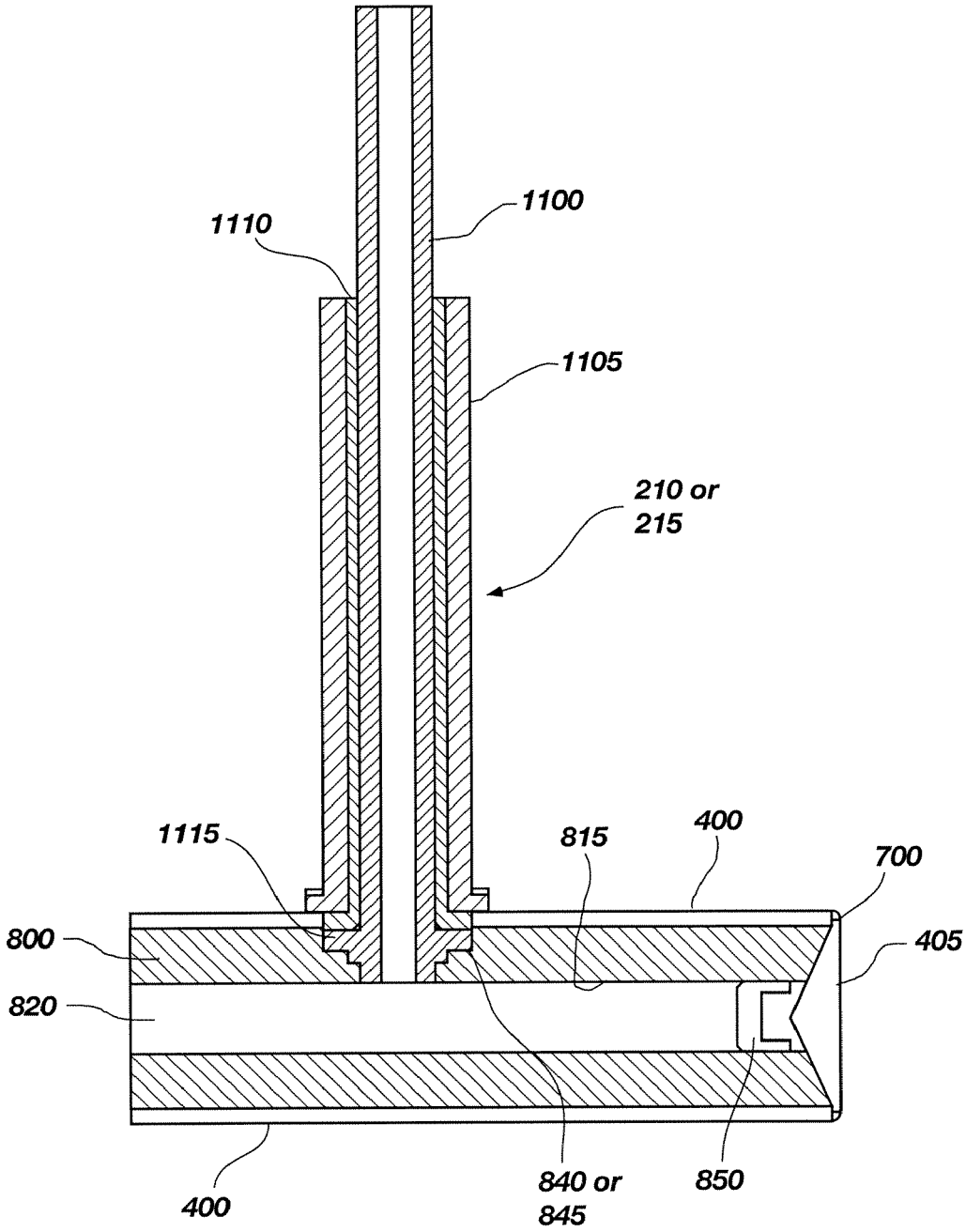

Referring also to FIGS. 6A, 6B, and 7, the end caps 405 include an inner flat surface 600, an outer flat surface 605, an outer cylindrical surface 610, and a conical surface 615. A width 620 between the inner flat surface 600 and the outer flat surface 605 can be about 0.25 mm. As mentioned, the end caps 405 fit into the end of the cylindrical barrier wall 400 such that the outer flat surface 605 and the outer cylindrical surface 610 are external to the central axial opening 515, the conical surface 615 abuts the central axial opening 515, and the inner flat surface 600 contacts the end of the cylindrical barrier wall 400. The end caps 405 are attached to the end of the cylindrical barrier wall 400 by a weld 700 such that the end caps 405 hermetically seal the working fluid within the cylindrical barrier wall 400. The weld 700 extends from the cylindrical barrier wall 400 over the outer cylindrical surface 610. The end caps 405 can be made of stainless steel or any suitable material that can be attached to the cylindrical barrier wall 400.

Referring also to FIGS. 8, 9, 10A, 10B, and 10C, the evaporator 105 includes the cylindrical wick 800 that is housed within the central axial opening 515 of the cylindrical barrier wall 400. The cylindrical wick 800 includes an outer surface 805 that is shaped to fit within the central axial opening 515. The inner surface 510 that defines the central axial opening 515 can be reamed and polished and the outer surface 805 of the cylindrical wick 800 can be machined to facilitate thermal contact between the cylindrical wick 800 and the cylindrical barrier wall 400.

The cylindrical wick 800 also includes an inner surface 815 that defines a central axial channel 820 that holds working fluid, and side surfaces 810 that connect the inner surface 815 to the outer surface 805. Because the inner surface 815 is shorter in the axial direction than the outer surface 805, the side surfaces 810 are angled to receive the end caps 405. Moreover, because the end caps 405 are conically shaped and have a width 620 that is thin relative to the overall side of the end caps 405, the outer surface 805 of the cylindrical wick 800 extends from or near one edge of the cylindrical barrier wall 400 to or near to another edge of the cylindrical barrier wall 400, such as, for example, to within 0.25 mm of the edge of the cylindrical barrier wall 400. Configured as such, the working liquid within the evaporator 105 can flow through the entire length of the cylindrical barrier wall 400, which receives the heat through the heat-receiving saddle 205.

Figure 13A:
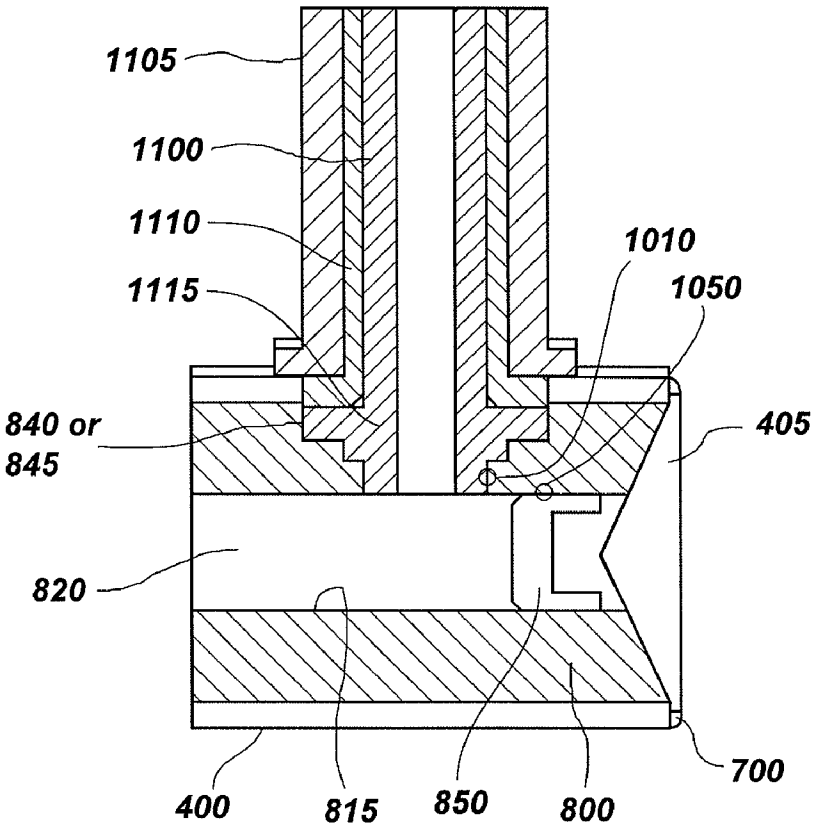
FIGS. 12 and 13A are axial cross-sectional views of portions of the evaporator of FIG. 2.
Figure 13B:
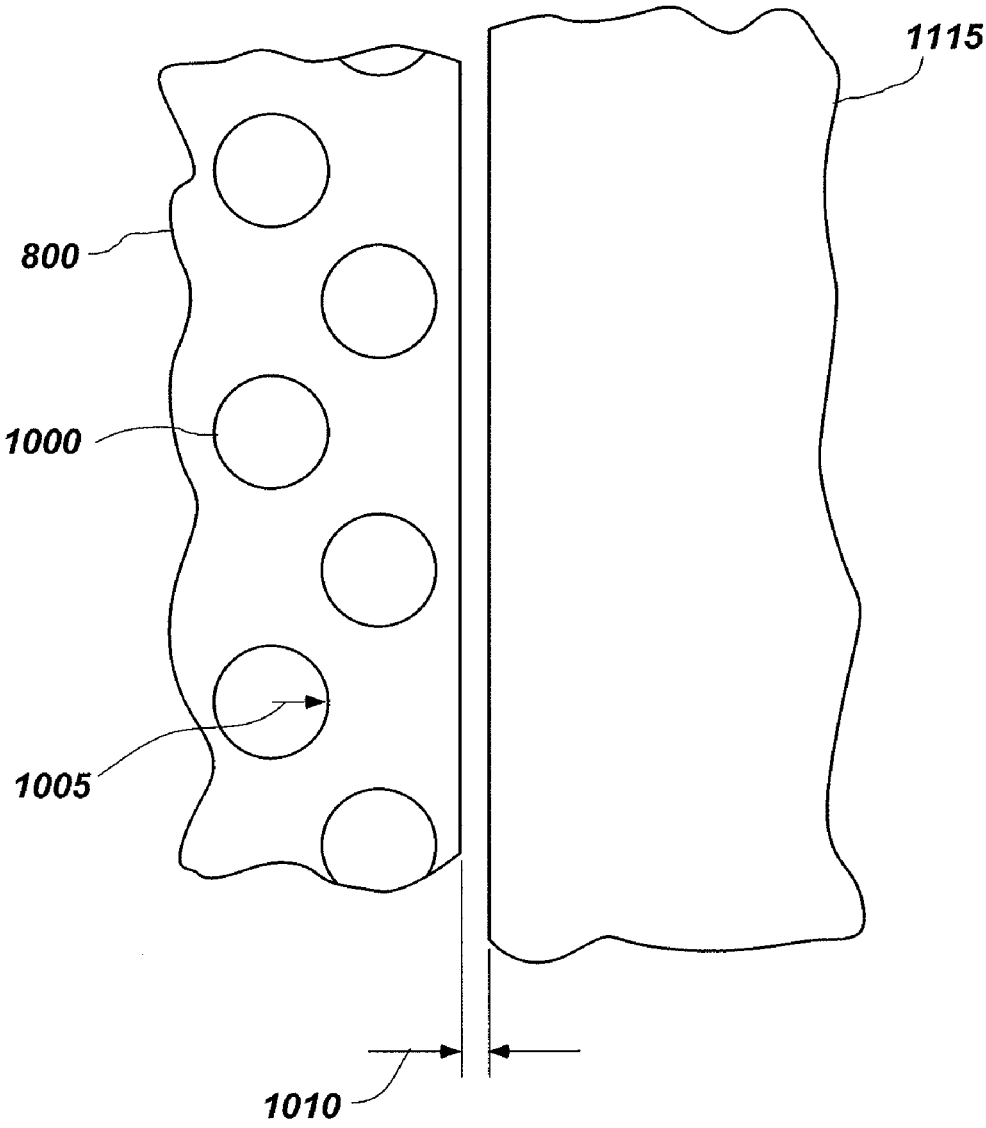
FIG. 13B is a schematic of a portion of the evaporator of FIG. 13A.

The cylindrical wick 800 also includes circumferential vapor grooves 825 formed into and wrapping around the outer surface 805 and at least one outer axial vapor channel 830 formed into the outer surface 805. The circumferential vapor grooves 825 are fluidly connected to the outer axial vapor channel 830, which connects to a vapor port passage 835. Referring also to FIG. 13B, the cylindrical wick 800 is made of a material having pores 1000 that have radii 1005 to promote liquid capillary flow. The radii 1005 can be from about one to several micrometers and in one implementation in which the cylindrical wick 800 is made of titanium, the pores 1000 have radii 1005 of about 1.5 μm.

The vapor port passage 835 is fluidly coupled to the vapor port 220. The vapor port 220 extends through the hole 425 of the cylindrical barrier wall 400 and ends adjacent to the vapor port passage 835 of the cylindrical wick 800. The vapor port 220 is hermetically sealed to the cylindrical barrier wall 400 by welding the vapor port 220 to the cylindrical barrier wall 400 at the hole 425. The vapor port 220 can be a single-walled tube made of a material that is suitable for hermetic sealing, such as stainless steel.

The cylindrical wick 800 also includes liquid port passages 840, 845 that are fluidly coupled, respectively, to the liquid ports 210, 215 such that the liquid ports 210, 215 extend through the passages 840, 845 and open into the central axial channel 820. Referring also to FIGS. 11-13A, each of the liquid ports 210, 215 is designed as a double-walled assembly having an inner tube 1100 and an outer sleeve 1105, where the inner tube is within the outer sleeve 1105 and both the inner tube 1100 and the outer sleeve 1105 extend along the axis of the liquid port 210, 215. A first region 1110 of the inner tube 1100 is attached to and hermetically sealed to the outer sleeve 1105 by, for example, welding the inner tube 1100 to the outer sleeve 1105 at the first region 1110. A second region 1115 of the inner tube 1100 is sealed to the cylindrical wick 800. Referring also to FIG. 13B, the second region 1115 of the inner tube 1100 is sealed to the cylindrical wick 800 in such manner that a gap 1010 between the inner tube 1100 (at the second region 1115) and the cylindrical wick 800 is smaller than the radius 1005 of the pores 1000 within the cylindrical wick 800. For example, the second region 1115 can be welded directly to the cylindrical wick 800, the second region 1115 can be mechanically compressed to the cylindrical wick 800, or the second region 1115 can be press fit to the cylindrical wick 800. The outer sleeve 1105 is attached to the cylindrical barrier wall 400 by, for example, welding. The first region 1110 of the inner tube 1100 can be made of a first metal such as stainless steel, and the second region 1115 of the inner tube 1100 can be made of a second metal such as titanium or any material suitable for sealing to the cylindrical wick 800. The first region 1110 can be joined with the second region 1115 using a frictional welding technique in which a metallurgical bond is formed between the first region 1110 and the second region 1115. The outer sleeve 1105 can be made of stainless steel or nickel.

Figure 13C:
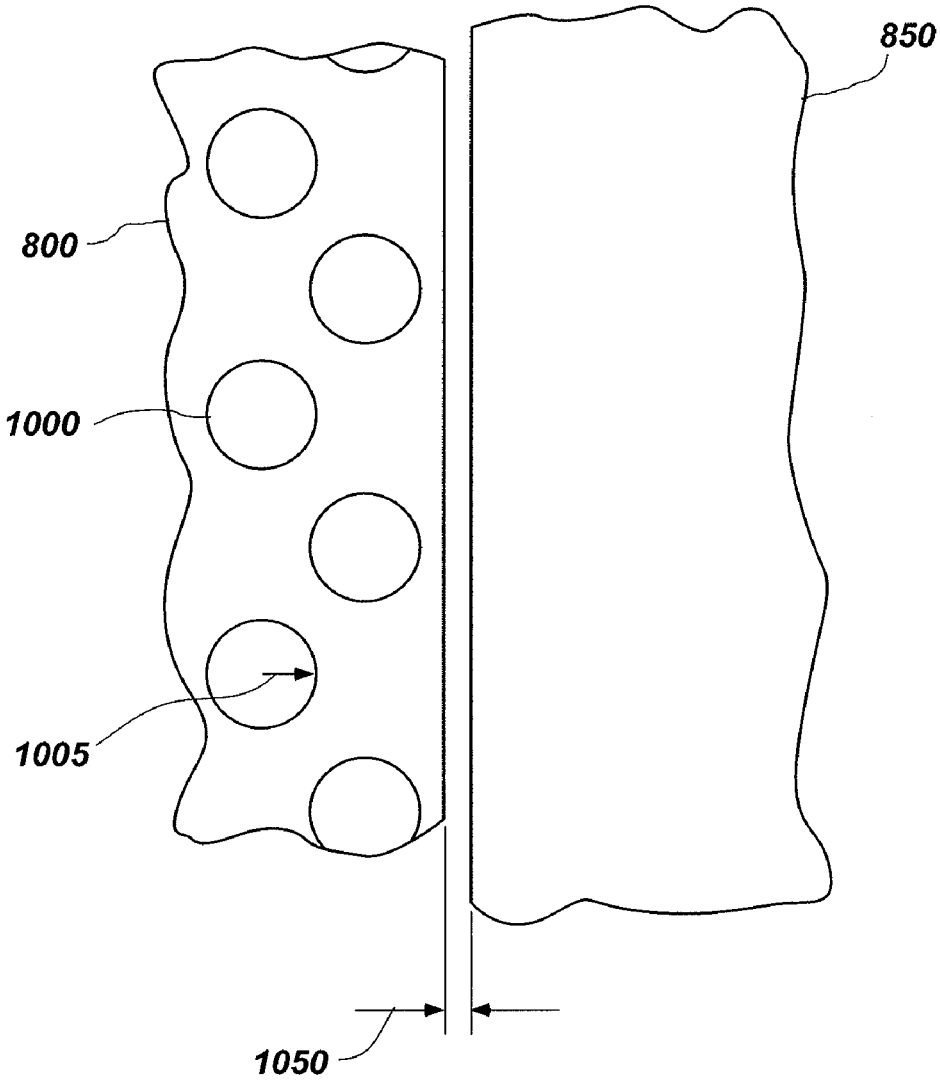
FIG. 13C is a schematic of a portion of the evaporator of FIG. 13A.

The evaporator 105 also includes a set of plugs 850 that fit within the central axial channel 820. The plugs 850 are made of a solid material that is compatible for attachment to the cylindrical wick 800; for example, if the cylindrical wick 800 is made of titanium, the plugs 850 can be made of titanium or any material suitable for sealing to the cylindrical wick 800. The plugs 850 can be welded directly to the cylindrical wick 800, the plugs 850 can be mechanically compressed into the cylindrical wick 800, or the plugs 850 can be press fit into the cylindrical wick 800. The plugs 850 are attached to the inner surface 815 of the cylindrical wick 800 by welding or any other appropriate sealing mechanism that prevents any fluids from flowing between the plugs 850 and the cylindrical wick 800. Referring also to FIG. 13C, the plug 850 is attached to the cylindrical wick 800 in such a manner that a gap 1050 between the plug 850 and the cylindrical wick 800 is smaller than the radius 1005 of the pores 1000 within the cylindrical wick 800.

In operation, the heat transfer system 100 transfers heat from a heat source adjacent the heat-receiving saddle 205 of the evaporator 105 to the condenser 110. Working fluid from the condenser 110 flows through the liquid inlet port 210, through the liquid port passage 840 of the cylindrical wick 800, and into the central axial channel 820, which acts as a liquid flow channel. The liquid flows through the cylindrical wick 800 as heat is applied or input to the heat-receiving saddle 205 and, therefore, to the outer cylindrical surface 505 of the cylindrical barrier wall 400. The liquid evaporates, forming vapor that is free to flow along the circumferential vapor grooves 825, along the outer axial vapor channel 830 (see FIG. 10C), the vapor port passage 835, and the vapor port 220 to the vapor line 120. Substantially the entire outer cylindrical surface 505 of the cylindrical barrier wall 400 acts as a heat-absorbing surface because the cylindrical wick 800 is designed to extend to nearly the end of the cylindrical barrier wall 400, thus enabling heat transfer at the end.

As mentioned above in FIG. 1, several evaporators having the design of the evaporator 105 can be connected into a fluid flow network in the heat transfer system 100. These several evaporators 105 can be connected either in series (as shown in FIG. 1) or in parallel in such manner that the working liquid can flow into and out of each evaporator through the liquid ports. A parallel fluid flow network is shown, for example, in FIG. 7 of U.S. application Ser. No. 10/602,022, now U.S. Pat. No. 7,004,240, issued Feb. 28, 2006, which is incorporated herein by reference in its entirety. The liquid mass flow rate into the evaporators in the network is controlled by the pumping system. The liquid mass flow rate into one of the evaporators in the network should exceed the vapor mass flow rate coming out of that evaporator, such that the liquid mass flow rate coming out of each evaporator is greater than zero.

Other implementations are within the scope of the following claims.

The materials for the evaporator 105 may be chosen to improve operating performance of the evaporator 105 for a particular temperature operating range.

As mentioned, the cylindrical wick 800 can be made of any suitable porous material, such as, for example, nickel, stainless steel, porous Teflon, or porous polyethylene.

In another implementation, the pumping system for the heat transfer system 100 may include a secondary loop including a secondary evaporator. Additionally, the evaporator 105 may include a secondary wick to sweep vapor bubbles out of the wick and into the secondary loop. In this way, vapor bubbles that form within the central axial channel 820 can be swept out of the channel 820 through a vapor passage and into a fluid outlet. In such a design, the secondary wick acts to separate the vapor and liquid within the central axial channel 820 of the cylindrical wick 800. Such a design is shown, for example, in U.S. application Ser. No. 10/602,022, now U.S. Pat. No. 7,004,240, issued Feb. 28, 2006.

Figure 14:
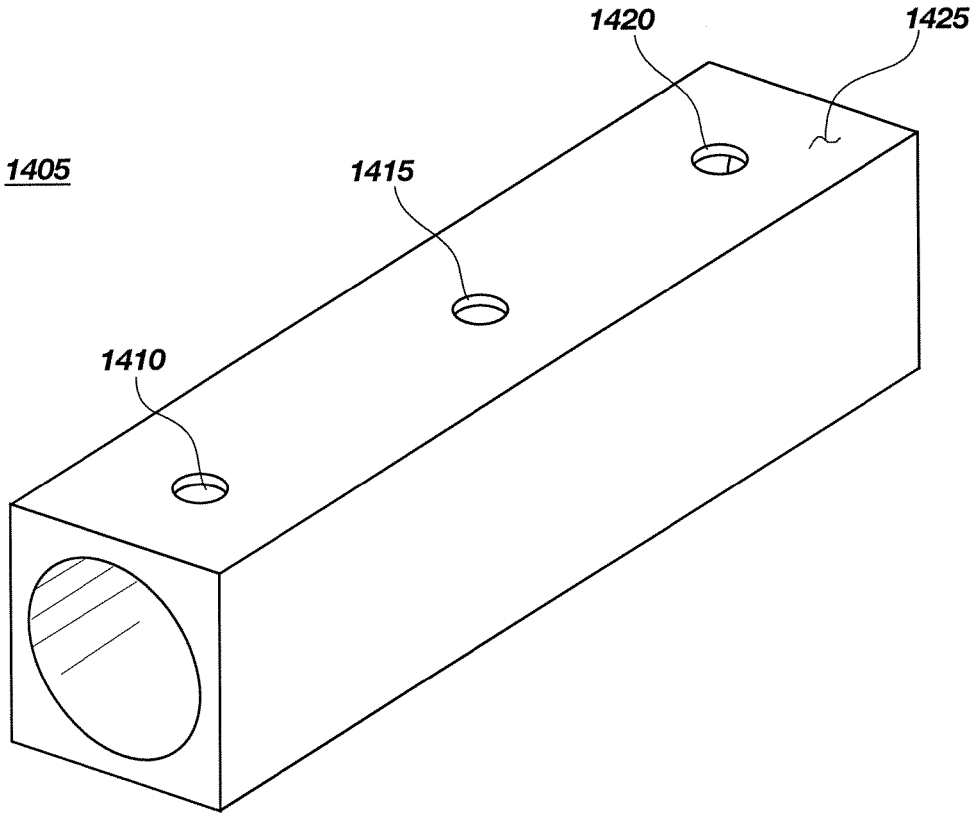
FIG. 14 is a perspective view of a heat-receiving saddle that can be used in the evaporator of FIG. 2.

Referring to FIG. 14, a heat-receiving saddle 1405 may be designed with discrete openings 1410, 1415, 1420 along a side 1425 of the heat-receiving saddle 1405. The discrete openings 1410, 1415, 1420 are aligned, respectively, with the ports 210, 215, 220 to permit the ports to extend through the heat-receiving saddle 1405.

The reservoir 130 can be cold biased to the condenser 110 or the radiator 125 and it can be controlled with additional heating.

Instead of making the cap 405 and the plug 850 as separate pieces, the cap and the plug can be made as an integral piece. For example, the cap may include a plug protrusion within the central axial opening and attached to the cylindrical wick.

The circumferential vapor grooves need not be formed solely into the outer surface of the wick. The circumferential vapor grooves may be defined along the interface between the wick and the cylindrical barrier wall. For example, the circumferential vapor grooves may be formed into the inner surface of the cylindrical barrier wall but not into the outer surface of the wick. As another example, the circumferential vapor grooves may be partially formed into the inner surface of the cylindrical barrier wall and partially formed into the outer surface of the wick.

The outer axial vapor channel need not be formed solely into the outer surface of the wick. The outer axial vapor channel may be defined along the interface between the wick and the cylindrical barrier wall. For example, the outer axial vapor channel may be formed into the inner surface of the cylindrical barrier wall but not into the outer surface of the wick. As another example, the outer axial vapor channel may be partially formed into the inner surface of the cylindrical barrier wall and partially formed into the outer surface of the wick.

What is claimed is:

1. An evaporator comprising:

a cylindrical barrier wall defining a central axial opening and an outer cylindrical surface, the cylindrical barrier wall having a length, a first axial end, a second axial end and being closed from fluid flow at both the first axial end and the second axial end;

a cylindrical wick disposed within the central axial opening, defining a central axial channel and extending substantially along the entire length of the cylindrical barrier wall from the first axial end to the second axial end;

a liquid inlet port extending through the cylindrical barrier wall and through a passage in the cylindrical wick to a location proximate to an inner surface of the cylindrical wick defining the central axial channel and directly communicating with the central axial channel;

a liquid outlet port extending through the cylindrical barrier wall and through a passage in the cylindrical wick to a location proximate to an inner surface of the cylindrical wick defining the central axial channel and directly communicating with the central axial channel; and a vapor port extending through the cylindrical barrier wall to a location proximate to an outer surface of the cylindrical wick.

2. The evaporator of claim 1, further comprising a sleeve that is attached to the cylindrical barrier wall at each of the liquid inlet port and the liquid outlet port.

3. The evaporator of claim 2, wherein each sleeve is welded to the cylindrical barrier wall at the outer cylindrical surface.

4. The evaporator of claim 1, further comprising:

an outer sleeve defining a sleeve axis at each of the liquid inlet port and the liquid outlet port; and a tube within each outer sleeve and extending along the sleeve axis;

wherein:

a first region of the tube is attached to an outer sleeve and a second region of the tube extends into the cylindrical wick; and each outer sleeve is attached to the cylindrical barrier wall.

5. An evaporator comprising:

a cylindrical barrier wall defining a central axial opening and an outer cylindrical surface, the cylindrical barrier wall having a length, a first axial end, a second axial end and being closed from fluid flow at both the first axial end and the second axial end;

a cylindrical wick disposed within the central axial opening, defining a central axial channel and extending substantially along the entire length of the cylindrical barrier wall from the first axial end to the second axial end;

a liquid inlet port extending through the cylindrical barrier wall and through the cylindrical wick to the central axial channel;

a liquid outlet port extending through the cylindrical barrier wall and through the cylindrical wick to the central axial channel;

a vapor port extending through the cylindrical barrier wall to proximate an outer surface of the cylindrical wick;

an outer sleeve defining a sleeve axis at each of the liquid inlet port and the liquid outlet port; and a tube within each outer sleeve and extending along the sleeve axis; and wherein:

a first region of the tube is attached to an outer sleeve and a second region of the tube extends into the cylindrical wick;

each outer sleeve is attached to the cylindrical barrier wall; and the second region of the tube is sealed to the cylindrical wick in such manner that a gap between the tube at the second region and the cylindrical wick is smaller than a radius of pores within the cylindrical wick.

6. An evaporator comprising:

a cylindrical barrier wall defining a central axial opening and an outer cylindrical surface, the cylindrical barrier wall having a length, a first axial end, a second axial end and being closed from fluid flow at both the first axial end and the second axial end;

a cylindrical wick disposed within the central axial opening, defining a central axial channel and extending substantially along the entire length of the cylindrical barrier wall from the first axial end to the second axial end;

a liquid inlet port extending through the cylindrical barrier wall and through the cylindrical wick to the central axial channel;

a liquid outlet port extending through the cylindrical barrier wall and through the cylindrical wick to the central axial channel;

a vapor port extending through the cylindrical barrier wall to proximate an outer surface of the cylindrical wick;

an outer sleeve defining a sleeve axis at each of the liquid inlet port and the liquid outlet port; and a tube within each outer sleeve and extending along the sleeve axis; and wherein:

a first region of the tube is attached to an outer sleeve and a second region of the tube extends into the cylindrical wick;

each outer sleeve is attached to the cylindrical barrier wall;

the tube is made of a first metal at the first region and the tube is made of a second metal at the second region;

the first region of the tube is welded to the outer sleeve; and the second region of the tube is welded to the cylindrical wick.

7. The evaporator of claim 1, further comprising a heat-receiving saddle that covers at least part of the outer cylindrical surface of the cylindrical barrier wall and having at least one opening in the heat-receiving saddle corresponding to at least one of the liquid inlet port, the liquid outlet port, and the vapor port.

8. The evaporator of claim 7, wherein the heat-receiving saddle is made of a material having a coefficient of thermal expansion of about two times the magnitude of the coefficient of thermal expansion of the heat source applied to the evaporator.

9. The evaporator of claim 1, further comprising a first cap disposed at the first axial end of the cylindrical barrier wall and closing the cylindrical barrier wall from fluid flow at the first axial end.

10. The evaporator of claim 9, further comprising a second cap disposed at the second axial end of the cylindrical barrier wall and closing the cylindrical barrier wall from fluid flow at the second axial end.

11. The evaporator of claim 9, wherein the first cap includes a substantially conical surface extending at least partially into the central axial opening.

* * * * *

UNITED STATES PATENT AND TRADEMARK OFFICE

CERTIFICATE OF CORRECTION

PATENT NO. : 7,661,464 B2
APPLICATION NO. : 11/275105
DATED : February 16, 2010
INVENTOR(S) : Dmitry Khrustalev et al.

It is certified that error appears in the above-identified patent and that said Letters Patent is hereby corrected as shown below:

On the title page:

In ITEM [56] References Cited

OTHER PUBLICATIONS

Page 3, 2nd column, (line 19), change "Pasive" to --Passive--

Page 3, 2nd column, (line 34), change "PCT/USO4/35548." to --PCT/US04/35548.--

Signed and Sealed this
Sixteenth Day of July, 2013

Teresa Stanek Rea

Teresa Stanek Rea
*Acting Director of the United States Patent and Trademark Office*